US010297205B2

(12) United States Patent
Hwang et al.

(10) Patent No.: US 10,297,205 B2
(45) Date of Patent: May 21, 2019

(54) PIXEL AND ORGANIC LIGHT EMITTING DISPLAY DEVICE INCLUDING THE PIXEL

(71) Applicant: Samsung Display Co., Ltd., Yongin-si, Gyeonggi-do (KR)

(72) Inventors: Young In Hwang, Yongin-si (KR); Ji Hye Kong, Yongin-si (KR); Yong Sung Park, Yongin-si (KR); Dong Bum Lee, Yongin-si (KR); In Ho Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 85 days.

(21) Appl. No.: 15/377,800

(22) Filed: Dec. 13, 2016

(65) Prior Publication Data

US 2017/0221422 A1 Aug. 3, 2017

(30) Foreign Application Priority Data

Feb. 3, 2016 (KR) ..... 10-2016-0013529

(51) Int. Cl.

*G09G 3/3291* (2016.01)
*G09G 3/3266* (2016.01)
*G09G 3/3233* (2016.01)

(52) U.S. Cl.

CPC ..... *G09G 3/3291* (2013.01); *G09G 3/3233* (2013.01); *G09G 3/3266* (2013.01); *G09G 2300/0819* (2013.01); *G09G 2300/0842* (2013.01); *G09G 2300/0861* (2013.01); *G09G 2300/0871* (2013.01); *G09G 2310/0289* (2013.01); *G09G 2310/08* (2013.01); *G09G 2330/028* (2013.01)

(58) Field of Classification Search

CPC ..... G09G 3/3291; G09G 3/3266
See application file for complete search history.

(56) References Cited

U.S. PATENT DOCUMENTS

2008/0224965 A1* 9/2008 Kim ..... G09G 3/3233 345/76
2010/0020059 A1* 1/2010 Suh ..... G09G 3/3233 345/212
2011/0316892 A1* 12/2011 Sung ..... G09G 3/3233 345/690

FOREIGN PATENT DOCUMENTS

KR 10-1182238 9/2012

* cited by examiner

*Primary Examiner* — Carolyn R Edwards
(74) *Attorney, Agent, or Firm* — Lewis Roca Rothgerber Christie LLP

(57) ABSTRACT

A pixel includes a first transistor connected between a data line and a first node, a second transistor including a second electrode connected to a second node, and a gate electrode connected to the first node, a third transistor connected between a reference power supply and the first node, a fourth transistor including a first electrode connected to a first power supply, and a second electrode connected to a first electrode of the second transistor, a capacitor including a first electrode connected to the first node, and a second electrode connected to the second node, an organic light emitting diode connected between the second node and a second power supply, a fifth transistor connected to an anode of the organic light emitting diode, and a sixth transistor including a first electrode connected to the fifth transistor, and a second electrode connected to an initialization power supply.

25 Claims, 9 Drawing Sheets

PIXEL AND ORGANIC LIGHT EMITTING DISPLAY DEVICE INCLUDING THE PIXEL

CROSS-REFERENCE TO RELATED APPLICATION

This application claims priority to, and the benefit of, Korean Patent Application No. 10-2016-0013529, filed on Feb. 3, 2016 in the Korean Intellectual Property Office, the entire contents of which are incorporated herein by reference in their entirety.

BACKGROUND

1. Field

Embodiments of the invention relate to a pixel, and to an organic light emitting display device including the pixel.

2. Description of the Related Art

An organic light emitting device may display an image by using an organic light emitting diode that generates light by recombination of electrons and holes. The organic light emitting device has a high response speed, and displays a clear image.

In general, an organic light emitting device may include a plurality of pixels each including a driving transistor and an organic light emitting diode. Each of the pixels may display a corresponding grayscale image by controlling the amount of current supplied to the organic light emitting diode by using the driving transistor thereof.

SUMMARY

Embodiments of the invention provide a pixel capable of controlling a threshold voltage compensation time of a driving transistor, a method of driving the pixel, and an organic light emitting display device including the pixel.

An embodiment of the present invention provides a pixel including a first transistor including a first electrode connected to a data line, and a second electrode connected to a first node, a second transistor including a first electrode, a second electrode connected to a second node, and a gate electrode connected to the first node, a third transistor including a first electrode connected to a reference power supply, and a second electrode connected to the first node, a fourth transistor including a first electrode connected to a first power supply, and a second electrode connected to the first electrode of the second transistor, a capacitor including a first electrode connected to the first node, and a second electrode connected to the second node, an organic light emitting diode connected between the second node and a second power supply, a fifth transistor connected to an anode of the organic light emitting diode, and a sixth transistor including a first electrode connected to the fifth transistor, and a second electrode connected to an initialization power supply.

The fifth transistor may include a first electrode connected to the anode of the organic light emitting diode, a second electrode connected to the sixth transistor, and a gate electrode connected to an ith light emission control line, where i is a natural number.

The third transistor may further include a gate electrode connected to an (i−1)th scan line, and the sixth transistor may further include a gate electrode connected to an (i+1)th scan line.

The second transistor may be configured to maintain an off state during a first period, and the fifth transistor and the sixth transistor may be configured to maintain an on state during a second period.

The third transistor and the fourth transistor may be configured to maintain an on state during a third period.

The third period may be repeated at least twice at a time interval for a 1 frame period.

The first transistor may be configured to maintain an on state during a fourth period, and the fifth transistor and the sixth transistor may be configured to maintain an on state during a fifth period.

The pixel may further include a seventh transistor connected between the fifth transistor and the initialization power supply.

The third transistor may further include a gate electrode connected to an (i−2)th scan line, the sixth transistor may further include a gate electrode connected to an (i−1)th scan line, and the seventh transistor may include a first electrode connected to the first electrode of the sixth transistor, a second electrode connected to the second electrode of the sixth transistor, and a gate electrode connected to an ith scan line.

The fifth transistor and the sixth transistor may be configured to maintain an on state, and the seventh transistor may be configured to maintain an off state, during a second period, and a voltage of the initialization power supply may be transmitted to the second node during the second period.

Another embodiment of the present invention provides an organic light emitting display device including a plurality of pixels including n scan lines, n light emission control lines, and m data lines, where n and m are natural numbers that are greater than or equal to 2, a scan driver for supplying scan signals to the scan lines, and for supplying light emission control signals to the light emission control lines, and a data driver for supplying data signals to the data lines, wherein a pixel connected to an ith scan line, to an ith light emission control line, and to a jth data line, where i is a natural number that is less than or equal to n, and where j is a natural number that is less than or equal to m, includes a first transistor connected between the jth data line and a first node, and configured to be turned on in response to a scan signal supplied to the ith scan line, a second transistor including a first electrode, a second electrode connected to a second node, and a gate electrode connected to the first node, a third transistor including a first electrode connected to a reference power supply, and a second electrode connected to the first node, a fourth transistor including a first electrode connected to a first power supply, and a second electrode connected to the first electrode of the second transistor, wherein the fourth transistor is configured to be turned on in response to a light emission control signal supplied to the ith light emission control line, a capacitor including a first electrode connected to the first node, and a second electrode connected to the second node, an organic light emitting diode connected between the second node and a second power supply, a fifth transistor connected to an anode of the organic light emitting diode, and a sixth transistor including a first electrode connected to the fifth transistor, and a second electrode connected to an initialization power supply.

The fifth transistor may include a first electrode connected to the anode of the organic light emitting diode, a second electrode connected to the sixth transistor, and a gate electrode connected to the ith light emission control line.

The third transistor may further include a gate electrode connected to an (i−1)th scan line, and the sixth transistor may further include a gate electrode connected to an (i+1)th scan line.

The (i−1)th scan line may be configured to receive a scan signal during a first period and a third period, the ith scan line may be configured to receive a scan signal during a fourth period, and the (i+1)th scan line may be configured to receive a scan signal during a second period and a fifth period.

The ith light emission control line may be configured to receive a light emission control signal during the third period and a sixth period.

A voltage of the second node may be compensated corresponding to a threshold voltage of the second transistor whenever the third transistor and the fourth transistor are turned on after the second period ends.

The pixel may further include a seventh transistor including a first electrode connected to the first electrode of the sixth transistor, a second electrode connected to the second electrode of the sixth transistor, and a gate electrode connected to the ith scan line.

The third transistor may further include a gate electrode connected to an (i−2)th scan line, and the sixth transistor may further include a gate electrode connected to an (i−1)th scan line.

The (i−2)th scan line may be configured to receive a scan signal during a first period and a third period, the (i−1)th scan line may be configured to receive a scan signal during a second period, and the ith scan line may be configured to receive a scan signal during a fourth period.

The ith light emission control line may be configured to receive a light emission control signal during the first period, the second period and the third period, and a voltage of the second node may be compensated corresponding to a threshold voltage of the second transistor whenever the third transistor and the fourth transistor are turned on after the second period ends.

Another embodiment of the present invention provides a pixel, including a first transistor connected between a data line and a first node, a second transistor including a first electrode, a second electrode connected to a second node, and a gate electrode connected to the first node, a third transistor coupled between the first node and a reference power supply, and including a gate electrode connected to a control line, a fourth transistor including a first electrode connected to a first power supply, and a second electrode connected to the first electrode of the second transistor, a capacitor connected between the first node and the second node, an organic light emitting diode connected between the second node and a second power supply, and a fifth transistor including a first electrode connected to an anode of the organic light emitting diode, and a second electrode connected to an initialization power supply.

The first transistor may include a first electrode connected to the data line, a second electrode connected to the first node, and a gate electrode connected to an ith scan line, i being a natural number, the third transistor may include a first electrode connected to the reference power supply, and a second electrode connected to the first node, and the fourth transistor may include a gate electrode connected to a light emission control line.

The fifth transistor may further include a gate electrode connected to an (i+2)th scan line.

The fourth transistor may be configured to maintain an off state during a first period and a second period, and the third transistor and the fifth transistor may be configured to maintain an on state during the second period.

The third transistor and the fourth transistor may be configured to maintain an on state during a third period.

BRIEF DESCRIPTION OF THE DRAWINGS

Example embodiments are described hereinafter with reference to the accompanying drawings. The present system and method, however, should not be construed as being limited to these embodiments. Rather, these embodiments are provided to facilitate the understanding by those of ordinary skill in the art.

In the drawings, the dimensions of the figures may be exaggerated for clarity. It is understood that when an element is referred to as being "between" two elements, it may be the only element between the two elements, or one or more intervening elements may also be present. Like reference numerals refer to like elements throughout.

DETAILED DESCRIPTION

Figure 1:
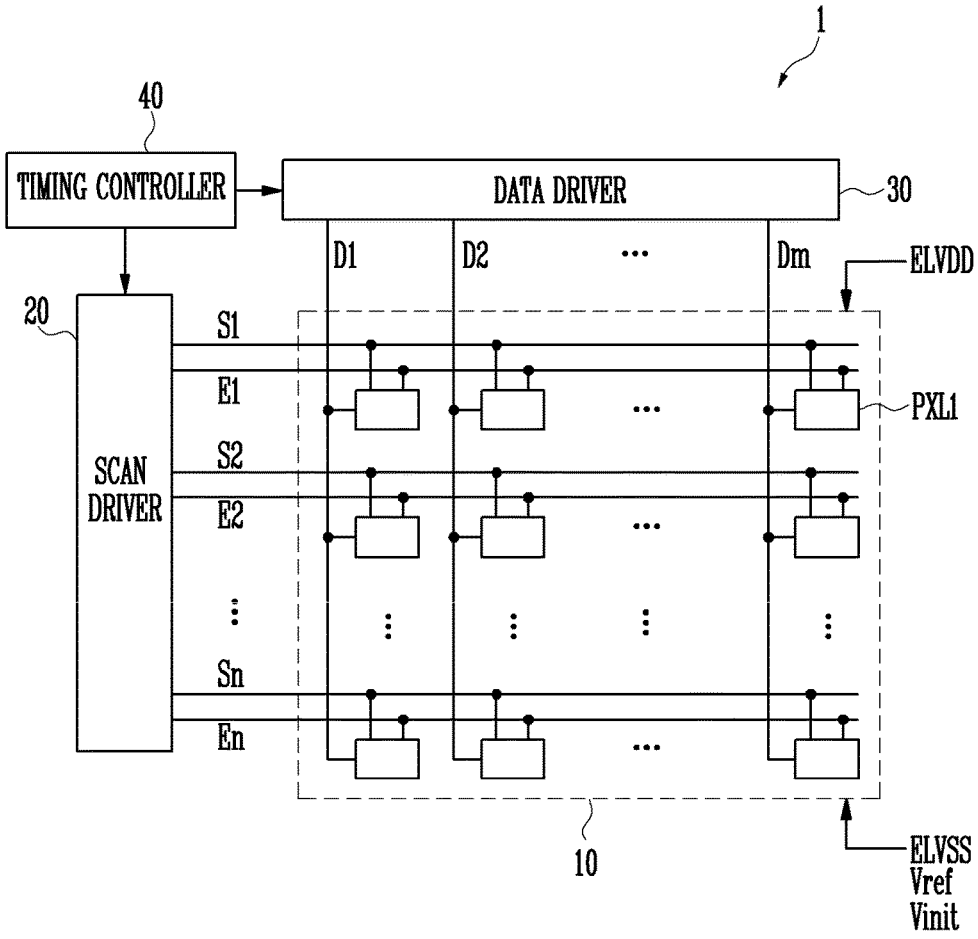
FIG. 1 is a diagram illustrating an organic light emitting display device according to an embodiment of the invention.

Features of the inventive concept and methods of accomplishing the same may be understood more readily by reference to the following detailed description of embodiments and the accompanying drawings. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. In addition, it will also be understood that when an element or layer is referred to as being "between" two elements or layers, it can be the only element or layer between the two elements or layers, or one or more intervening elements or layers may also be present.

In the following examples, the x-axis, the y-axis and the z-axis are not limited to three axes of a rectangular coordinate system, and may be interpreted in a broader sense. For example, the x-axis, the y-axis, and the z-axis may be perpendicular to one another, or may represent different directions that are not perpendicular to one another.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, a pixel, a method of driving the pixel and an organic light emitting display device including the pixel according to embodiments will be described in detail with reference to the accompanying drawings.

FIG. 1 is a diagram illustrating an organic light emitting display device according to an embodiment.

Referring to FIG. 1, an organic light emitting display device 1 according to an embodiment may include a pixel unit 10 including a plurality of pixels PXL1, a scan driver 20, a data driver 30, and a timing controller 40.

In addition, the organic light emitting display device 1 may further include n scan lines S1 to Sn and n light emission control lines E1 to En connected between the scan driver 20 and respective pixels PXL1, and m data lines D1 to Dm connected between the data driver 30 and respective pixels PXL1, where n and m are natural numbers greater than or equal to 2.

The pixels PXL1 may be coupled to respective ones of the scan lines S1 to Sn, the light emission control lines E1 to En, and the data lines D1 to Dm. Each of the pixels PXL1 may be coupled to a corresponding data line and to a corresponding light emission control line. For convenience of explanation, FIG. 1 illustrates each pixel PXL1 coupled to one of the scan lines. However, each pixel PXL1 may be coupled to a plurality of scan lines.

For example, the pixels PXL1 located in an ith line may be coupled to an (i−1)th scan line Si−1, to an ith scan line Si, to an (i+1)th scan line Si+1, and to an ith light emission control line Ei, where i is a natural number that is less than or equal to n.

The pixels PXL1 may receive a first power supply ELVDD, a second power supply ELVSS, a reference power supply Vref, and an initialization power supply Vinit from a power supply/power supply unit. In addition, each of the pixels PXL1 may generate light corresponding to a data signal by a current flowing from the first power supply ELVDD through the organic light emitting diode to the second power supply ELVSS.

The scan driver 20 may generate scan signals corresponding to a scan driving control signal supplied from the timing controller 40, and may supply the generated scan signals to the scan lines S1 to Sn. The scan driver 20 may supply the scan signals to the first to nth scan lines S1 to Sn in a sequential manner. The scan driver 20 may supply the scan signals so that the scan signal supplied to the ith scan line Si and the scan signal supplied to the (i+1)th scan line Si+1 do not overlap with each other. In addition, the scan driver 20 may generate light emitting control signals, and may supply the generated light emitting control signals to the light emission control lines E1 to En in response to control by the timing controller 40.

The data driver 30 may generate data signals, and may supply the generated data signals to the data lines D1 to Dm in response to control of the timing controller 50. Therefore, the pixels PXL1 may receive the data signals through the data lines D1 to Dm.

For convenience of explanation, FIG. 1 illustrates the scan driver 20, the data driver 30, and the timing controller 40 as being separate from each other. However, some or all of these components may be incorporated with each other.

In addition, FIG. 1 illustrates the n scan lines S1 to Sn and the n light emission control lines E1 to En. However, the invention is not limited thereto. For example, depending on the structure of the pixel PXL1, at least one dummy scan line and at least one light emission control line may be additionally included.

In addition, as described above, each of the pixels PXL1 may be additionally connected to a scan line and/or to a light emission control line located in a previous and/or subsequent horizontal line in accordance with the circuit configuration.

In addition, FIG. 1 illustrates the scan driver 20 coupled to the scan lines S1 to Sn and to the light emission control lines E1 to En. However, the invention is not limited thereto. For example, the light emission control lines E1 to En may be coupled to a separate driver, and may receive light emission control signals therefrom.

Figure 2:
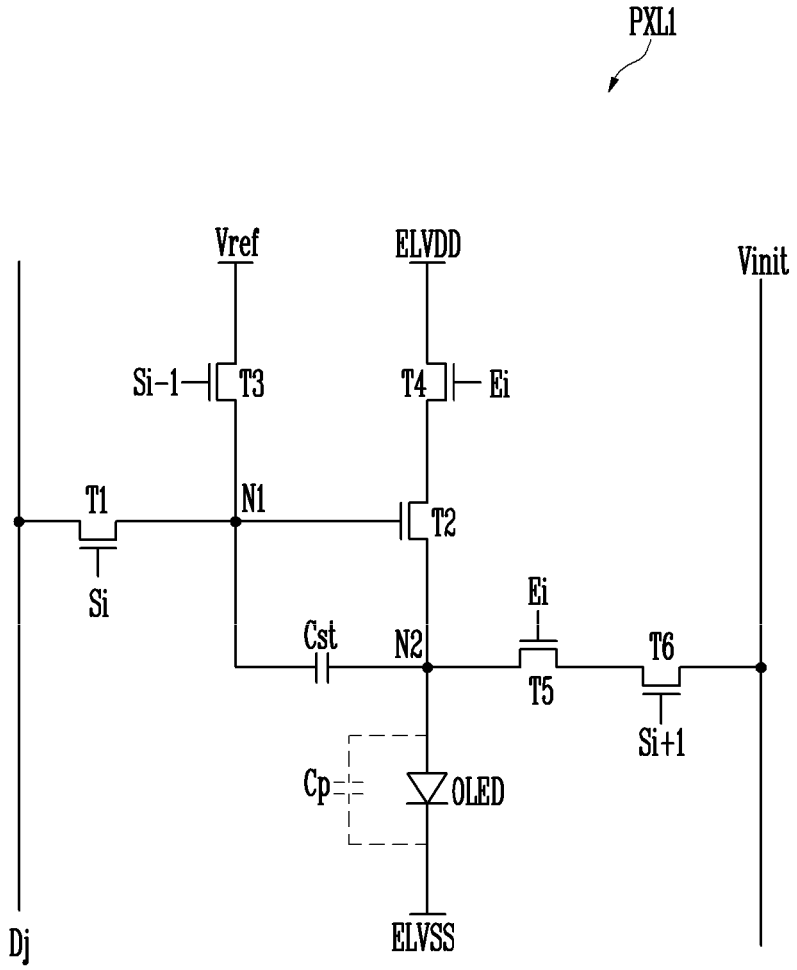
FIG. 2 is a circuit diagram illustrating an embodiment of a pixel shown in FIG. 1.

FIG. 2 is a circuit diagram illustrating an embodiment of a pixel shown in FIG. 1. For convenience of explanation, FIG. 2 illustrates the pixel PXL1 arranged at a crossing region of a jth data line Dj and the ith scan line Si, where i is a natural number that is less than or equal to n, and where j is a natural number that is less than or equal to m.

The pixel PXL1 may be coupled to the (i−1)th scan line Si−1 and to the (i+1)th scan line Si+1, and may also be coupled to the jth data line Dj, to the ith scan line Si, and to the ith light emission control line Ei.

Referring to FIG. 2, the pixel PXL1 may include a first transistor T1, a second transistor T2, a third transistor T3, a fourth transistor T4, a fifth transistor T5, a sixth transistor T6, a capacitor Cst, and an organic light emitting diode (OLED).

The first transistor T1 may be coupled between the jth data line Dj and a first node N1. For example, a first electrode of the first transistor T1 may be coupled to the jth data line Dj, a second electrode of the first transistor T1 may be coupled to the first node N1, and a gate electrode of the first transistor T1 may be coupled to the ith scan line Si. Therefore, the first transistor T1 may be turned on in response to a scan signal supplied to the ith scan line Si, and when the first transistor T1 is turned on, a data signal of the jth data line Dj may be transferred to the first node N1.

The second transistor T2 may be coupled between the first power supply ELVDD and a second node N2. For example, a first electrode of the second transistor T2 may be coupled to the first power supply ELVDD through the fourth transistor T4, a second electrode of the second transistor T2 may be coupled to the second node N2, and a gate electrode of the second transistor T2 may be coupled to the first node N1. The second transistor T2 may serve as a driving transistor for supplying a driving current to the organic light emitting diode OLED. For example, the second transistor T2 may supply the driving current corresponding to a voltage stored in the capacitor Cst to the organic light emitting diode OLED.

The third transistor T3 may be coupled between the reference power supply Vref and the first node N1. For example, a first electrode of the third transistor T3 may be coupled to the reference power supply Vref, a second electrode of the third transistor T3 may be coupled to the first node N1, and a gate electrode of the third transistor T3 may be coupled to the (i−1)th scan line Si−1. Therefore, the third transistor T3 may be turned on in response to a scan signal supplied to the (i−1)th scan line Si−1. When the third transistor T3 is turned on, a voltage of the reference power supply Vref may be transferred to the first node N1.

The fourth transistor T4 may be coupled between the first power supply ELVDD and the second transistor T2. For example, a first electrode of the fourth transistor T4 may be coupled to the first power supply ELVDD, a second electrode of the fourth transistor T4 may be coupled to the first electrode of the second transistor T2, and a gate electrode of the fourth transistor T4 may be coupled to the ith light emission control line Ei. Therefore, the fourth transistor T4 may be turned on in response to a light emission control signal supplied to the ith light emission control line Ei.

The fifth transistor T5 and the sixth transistor T6 may be coupled between the second node N2 and the initialization power supply Vinit. For example, a first electrode of the fifth transistor T5 may be coupled to the second node N2, a second electrode of the fifth transistor T5 may be coupled to the sixth transistor T6, and a gate electrode of the fifth transistor T5 may be coupled to the ith light emission control line Ei.

In addition, a first electrode of the sixth transistor T6 may be coupled to the second electrode of the fifth transistor T5, a second electrode of the sixth transistor T6 may be coupled to the initialization power supply Vinit, and a gate electrode of the sixth transistor T6 may be coupled to the (i+1)th scan line Si+1.

Therefore, the fifth transistor T5 may be turned on in response to the light emission control signal supplied to the ith light emission control line Ei. The sixth transistor T6 may be turned on in response to the scan signal supplied to the (i+1)th scan line Si+1. When both the fifth transistor T5 and the sixth transistor T6 are turned on, a voltage of the initialization power supply Vinit may be transferred to the second node N2.

The first electrode of each of the transistors T1, T2, T3, T4, T5, and T6 may be a source electrode or a drain electrode, and the second electrode thereof may be a different electrode from the first electrode. For example, when the first electrode is set as a drain electrode, the second electrode may be set as a source electrode.

The transistors T1, T2, T3, T4, T5, and T6 included in the pixel PXL1 may have the same channel type. For example, each of the first to sixth transistors T1, T2, T3, T4, T5, and T6 may be set as an n channel type.

The capacitor Cst may be coupled between the first node N1 and the second node N2. For example, a first electrode of the capacitor Cst may be coupled to the first node N1, a second electrode of the capacitor Cst may be coupled to the second node N2, and a voltage corresponding to the data signal may be stored in the capacitor Cst.

The organic light emitting diode OLED may be coupled between the second node N2 and the second power supply ELVSS. For example, an anode of the organic light emitting diode OLED may be coupled to the second node N2, and a cathode of the organic light emitting diode OLED may be coupled to the second power supply ELVSS. The organic light emitting diode OLED may receive the driving current from the second transistor T2, and may generate light with brightness corresponding to the driving current.

In addition, as indicated by dotted line in FIG. 2, a parasitic capacitor Cp may exist in the organic light emitting diode OLED.

Figure 3:
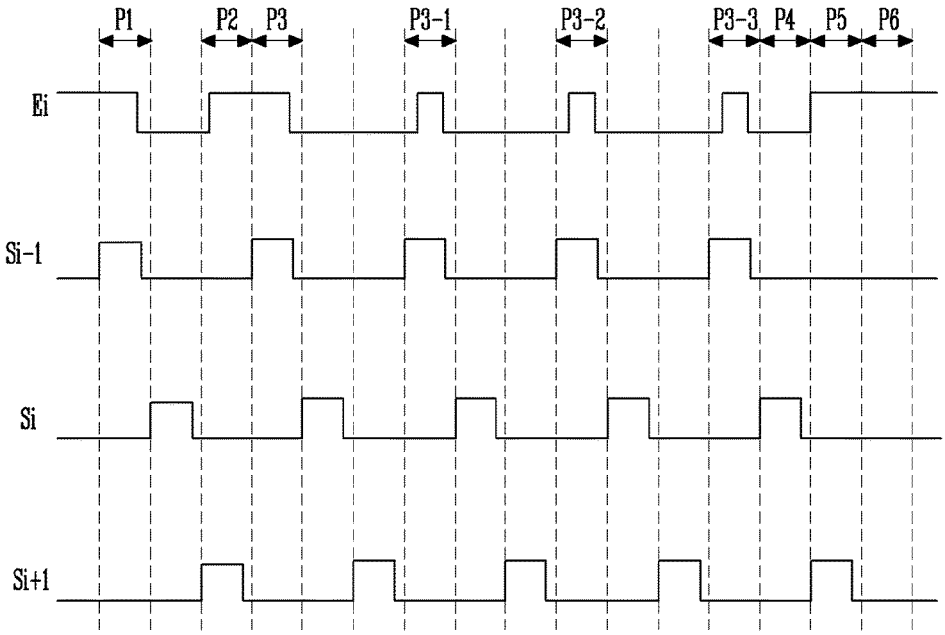
FIG. 3 is a diagram illustrating a driving waveform of a signal supplied to the pixel shown in FIG. 2.

FIG. 3 is a diagram illustrating driving waveforms of signals supplied to the pixel shown in FIG. 2. Hereinafter, a driving operation of the pixel PXL1 is described with reference to FIGS. 2 and 3.

Referring to FIG. 3, a method of driving the pixel PXL1 may include light emission off, first initialization, threshold voltage compensation, data write, second initialization, and light emission.

The light emission off may be performed during a first period P1. In the light emission off, the third transistor T3 may be turned on to supply a voltage of the reference power supply Vref (hereinafter, reference voltage) to the first node N1, and the fourth transistor T4 may maintain an on state.

Therefore, during the light emission off, the reference voltage may be supplied to the gate electrode of the second transistor T2. The reference power supply Vref may be a low potential power supply. When a low potential voltage is supplied to the gate electrode of the second transistor T2, the second transistor T2 may be turned off. When the second transistor T2 is turned off, a current path from the first power supply ELVDD to the second power supply ELVSS may be disconnected. Therefore, the light emission of the organic light emitting diode OLED may be turned off.

A voltage of the first node N1 may satisfy the following Equation (1):

$$VN1=Vref \quad \text{[Equation (1)]}$$

(where VN1 is the voltage of the first node N1 and Vref is the reference voltage).

During the first period P1, a scan signal and a light emission control signal (e.g., signals having a high level) may be supplied to the (i−1)th scan line Si−1 and the ith light emission control line Ei, respectively.

Subsequently, the fourth transistor T4, which has been maintaining the on state since the light emission of the previous frame, may be turned off. In addition, by turning off the third transistor T3 and turning on the first transistor T1, a data voltage may be supplied to the first node N1.

Even when the data voltage supplied to the first node N1 is supplied to the gate electrode of the second transistor T2, because the fourth transistor T4 is in an off state, the current path from the first power supply ELVDD to the second power supply ELVSS may still remain disconnected.

The voltage of the first node N1 may satisfy the following Equation (2):

$$VN1=Vdata' \quad \text{[Equation (2)]}$$

(where VN1 is the voltage of the first node N1 and Vdata' is a data voltage).

The first initialization may be performed during a second period P2. In the first initialization, by turning on the fifth transistor T5 and the sixth transistor T6, the voltage of the initialization power supply Vinit (hereinafter, an initialization voltage) may be supplied to the second node N2.

During the second period P2, a scan signal and the light emission control signal (e.g., signals having a high level) may be supplied to the (i+1)th scan line Si+1 and the ith light emission control line Ei, respectively.

The voltages of the first node N1 and the second node N2 may satisfy the following Equation (3):

$$VN1=Vdata'-(Voled_off-Vinit)$$

$$VN2=Vinit \quad \text{[Equation (3)]}$$

(where VN1 is the voltage of the first node N1, Vdata' is the data voltage, Voled_off is the voltage of the second node N2 before the first initialization starts and after the light emission off ends, VN2 is the voltage of the second node N2, and Vinit is the initialization voltage).

Because a voltage Vgs between a gate electrode and a source electrode of the second transistor T2 is less than a driving voltage of the second transistor, the second transistor T2 may be turned off, and the pixel PXL1 may be initialized so as to be unaffected by the previous unit period through the above-described initialization operation.

The threshold voltage compensation may be performed during a third period P3. During the threshold voltage compensation, by turning on the third transistor T3 and the fourth transistor T4, a threshold voltage of the second transistor T2 may be stored in the capacitor Cst.

During the third period P3, a scan signal and the light emission control signal may be supplied to the (i−1)th scan line Si−1 and the ith light emission control line Ei, respectively.

Therefore, during the third period P3, the third transistor T3, the fourth transistor T4, and the fifth transistor T5 may maintain an on state, and the first transistor T1 and the sixth transistor T6 may maintain an off state.

Because the third transistor T3 maintains the on state in response to the scan signal supplied to the (i−1)th scan line Si−1 during the third period P3, the voltage of the first node N1 may change from the data voltage to the reference voltage again.

In addition, during the third period P3, the voltage of the second node N2 may change from the initialization voltage to a value obtained by subtracting the threshold voltage of the second transistor T2 from the reference voltage.

Because the capacitance of the parasitic capacitor Cp of the organic light emitting diode OLED is much greater than the capacitance of the capacitor Cst, even when the voltage of the first node N1 changes, the second node N2 might not be affected by the change in voltage thereof.

The voltages of the first node N1 and the second node N2 may satisfy the following Equation (4):

$$VN1=Vref$$

$$VN2=Vref-Vth \quad \text{[Equation (4)]}$$

(where VN1 is the voltage of the first node N1, Vref is the reference voltage, VN2 is the voltage of the second node N2, and Vth is the threshold voltage of the second transistor T2).

The above-described threshold voltage compensation may be repeated at least two times. As shown in FIG. 3, threshold voltage compensation may be performed during a (3-1)th period P3-1, a (3-2)th period P3-2 and a (3-3)th period P3-3.

In the threshold voltage compensation processes performed during the (3-1)th period P3-1, the (3-2)th period P3-2 and the (3-3)th period P3-3, the threshold voltage of the second transistor T2 may be stored in the capacitor Cst by turning on the third transistor T3 and the fourth transistor T4 in the same manner as the threshold voltage compensation performed during the third period P3.

During the (3-1)th period P3-1, the (3-2)th period P3-2 and the (3-3)th period P3-3, the scan signal and the light emission control signal may be supplied to the (i−1)th scan line Si−1 and the ith light emission control line Ei, respectively.

When the threshold voltage compensation is performed a plurality of times as described above, after one of the threshold voltage compensation processes ends, supply of the scan signal to the (i−1)th scan line Si−1 may be stopped before the next threshold voltage compensation starts (e.g., between the third period P3 and the (3-1)th period P3-1), and the scan signals may be sequentially supplied to the ith scan line Si and the (i+1)th scan line Si+1.

When the scan signals are sequentially supplied to the ith scan line Si and the (i+1)th scan line Si+1, supply of the light emission control signal may be stopped. In other words, the fourth transistor T4 may maintain an off state.

When the scan signal is supplied to the ith scan line Si, because the first transistor T1 is turned on, the voltage of the first node N1 may change from the initialization voltage to the data voltage. However, because the fourth transistor T4 is turned off, the voltage of the second node N2 may remain unchanged. Similarly, when the scan signal is supplied to the (i+1)th scan line Si+1, because the fourth transistor T4 is turned off, the voltage of the second node N2 may remain unchanged.

When a time taken to perform one threshold voltage compensation process is not long enough to compensate for the threshold voltage of the second transistor T2, a sufficient threshold voltage compensation period may be ensured by repeating the threshold voltage compensation a plurality of times as described above.

In FIG. 3, it is assumed that the threshold voltage compensation processes are performed during the (3-1)th period P3-1, the (3-2)th period P3-2, and the (3-3)th period P3-3 after the threshold voltage compensation is performed during the third period P3 (i.e., the threshold voltage compensation is repeated four times). However, the invention is not limited thereto, and the number of threshold voltage compensation processes may vary.

The data write may be performed during a fourth period P4. In the data write, a data signal may be supplied to the first node N1 by turning on the first transistor T1. Therefore, in the data write, the data signal transferred from the jth data line Dj may be supplied to the gate electrode of the second transistor T2.

A scan signal may be supplied to the ith scan line Si during the fourth period P4. Therefore, during the fourth period P4, the first transistor T1 may maintain an on state, while the third transistor T3, the fourth transistor T4, the fifth transistor T5 and the sixth transistor T6 may maintain an off state.

During the fourth period P4, the voltage of the first node N1 may be maintained at a voltage of the data signal (hereinafter, a data voltage). During the fourth period P4, the voltage of the first node N1 and the second node N2 may satisfy the following Equation (5):

$$VN1=Vdata$$

$$VN2=Vref-Vth \quad \text{[Equation (5)]}$$

(VN1 is the voltage of the first node N1, Vdata is the data voltage, Vref is the reference voltage, VN2 is the voltage of the second node N2, and Vth is the threshold voltage of the second transistor T2).

When there are a plurality of the pixels PXL1 according to an embodiment, the respective second transistors T2 included in the pixels PXL1 may have different threshold voltages as a result of variances in manufacturing processes. Therefore, voltages of the second nodes N2 of the pixel PXL1 may be differently set, so that a variation may occur in respective light emitting times of the pixels PXL1.

Therefore, the method of driving the pixel PXL1 according to the embodiment may include performing second initialization (described below) to equally initialize the voltages of the second nodes N2 of the respective pixels PXL1, so that a variation in anode voltages of the organic light emitting diodes OLED caused by a threshold voltage variation of the second transistors T2 may be compensated, and an emission time difference resulting from the threshold voltage variation of the second transistors T2 may be eliminated.

The second initialization may be performed during a fifth period P5. In the second initialization, by turning on the fifth transistor T5 and the sixth transistor T6, the initialization voltage may be supplied to the second node N2 again.

During the fifth period P5, the scan signal and the light emission control signal (e.g., signals having a high level) may be supplied to the (i+1)th scan line Si+1 and the ith light emission control line Ei, respectively. Therefore, the fifth transistor T5 and the sixth transistor T6 may maintain an on state at the same time, and the first transistor T1 and the third transistor T3 may maintain an off state.

When the initialization voltage is supplied to the second node N2, the voltage of the first node N1 may also change by a coupling operation of the capacitor Cst. Therefore, the voltage stored in the capacitor Cst during the data write may remain.

The voltages of first node N1 and the second node N2 may satisfy the following Equation (6):

$$VN1=Vdata-(Vref-Vth)$$

$$VN2=Vinit \quad \text{[Equation (6)]}$$

(VN1 is the voltage of the first node N1, Vdata is the data voltage, Vref is the reference voltage, Vth is the threshold voltage of the second transistor T2, VN2 is the voltage of the second node N2, and Vinit is the initialization voltage).

Lastly, the light emission may be performed during a sixth period P6. In the light emission, a driving current corresponding to the voltage stored in the capacitor Cst may be supplied to the organic light emitting diode OLED from the second transistor T2.

During the sixth period P6, the scan signals may not be supplied to the scan lines (the (i−1)th scan line, the ith scan line and the (i+1)th scan line). Therefore, the first transistor T1, the third transistor T3 and the sixth transistor T6 may maintain an off state.

During the sixth period P6, voltages according to the following Equation (7) may be stored in the first node N1 and in the second node N2, so that the second transistor T2 may supply current according to Equation (7) below to the organic light emitting diode.

$$VN1=Vdata+(Voled-Vref+Vth)$$

$$VN2=Voled$$

$$Ioled=k\times(Vgs-Vth)^2=k\times(Vdata-Vref)^2 \quad \text{[Equation (7)]}$$

(where VN1 is the voltage of the first node N1, Vdata is the data voltage, Voled is a driving voltage of the second transistor T2, Vref is the reference voltage, Vth is the threshold voltage of the second transistor T2, VN2 is the voltage of the second node N2, loled is a driving current output from the second transistor T2, and Vgs is a gate-source voltage of the second transistor T2).

In other words, as shown in Equation (7), the driving current output from the second transistor T2 may be determined regardless of a threshold voltage Vth. Therefore, uneven brightness caused by the threshold voltage variation of the driving transistors (e.g., second transistors T2) included in the respective pixels PXL1 (i.e., the threshold voltage variation, or the effects thereof, of the second transistors T2 may be eliminated).

Figure 4:
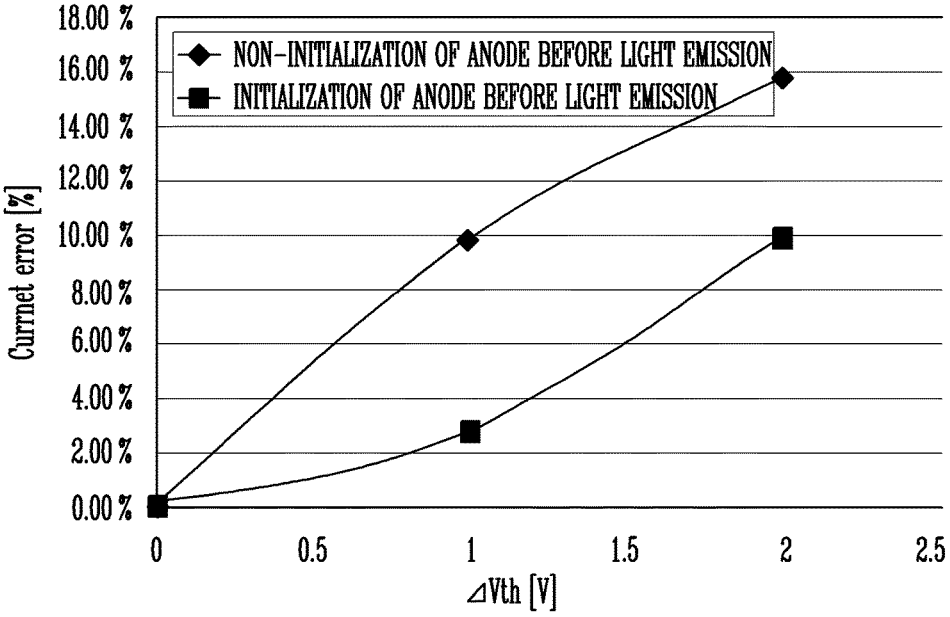
FIG. 4 is a graph illustrating the effects of performing light emission after second initialization is performed according to an embodiment.

FIG. 4 is a graph illustrating the effects of performing light emission after second initialization is performed according to an embodiment.

The horizontal axis of the graph shown in FIG. 4 may represent a variation ΔVth in threshold voltages of the second driving transistors T2, and the vertical axis may represent a current error. In other words, the graph shown in FIG. 4 may show the current error with respect to the variation ΔVth in the threshold voltages of the second driving transistors T2. As shown in FIG. 4, the current error may gradually increase as the variation ΔVth in threshold voltages of the second driving transistors T2 increases. However, as described above, it is shown that the current error decreases when the anode of the organic light emitting diode OLED (prior to light emission thereof) and the second node N2 are initialized to the initialization voltage.

Figure 5:
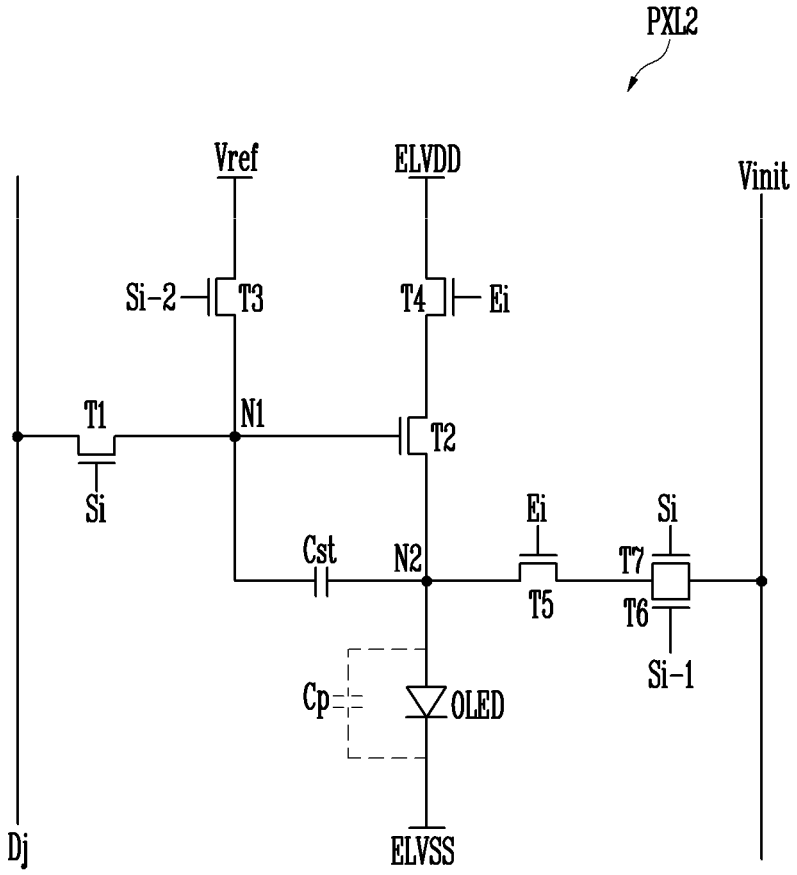
FIG. 5 is a diagram illustrating a pixel according to another embodiment.

FIG. 5 is a diagram illustrating a pixel according to another embodiment. Hereinafter, a description of common contents with the earlier described embodiment is omitted, and differences from the earlier described embodiment will be mainly described.

Referring to FIG. 5, a pixel PXL2 according to the present embodiment may further include a seventh transistor T7.

The seventh transistor T7 may be coupled between the fifth transistor T5 and the initialization power supply Vinit. More specifically, the seventh transistor T7 may be directly coupled (e.g., coupled in parallel) to the sixth transistor T6 provided between the fifth transistor T5 and the initialization power supply Vinit.

For example, a first electrode of the seventh transistor T7 may be coupled to both the second electrode of the fifth transistor T5 and to the first electrode of the sixth transistor T6, and a second electrode of the seventh transistor T7 may be coupled to both the initialization power supply Vinit and to the second electrode of the sixth transistor T6. A gate electrode of the seventh transistor T7 may be coupled to the ith scan line Si.

Because the seventh transistor T7 is further provided, the pixel PXL2 may be coupled to an (i−2)th scan line Si−2 and to the (i−1)th scan line Si−1, and may also be coupled to the jth data line Dj, to the ith scan line Si, and to the ith light emission control line Ei. More specifically, the (i−2)th scan line Si−2 may be coupled to the gate electrode of the third transistor T3, the (i−1)th scan line Si−1 may be coupled to the gate electrode of the sixth transistor T6, the ith scan line Si may be coupled to the gate electrodes of the first transistor T1 and the seventh transistor T7, and the ith light emission control line Ei may be coupled to the gate electrodes of the fourth transistor T4 and the fifth transistor T5. Therefore, the pixel PXL2 may operate in response to scan signals and a light emission control signal respectively supplied to the (i−2)th scan line Si−2, the (i−1)th scan line Si−1, the ith scan line Si, and the ith light emission control line Ei.

Figure 6:
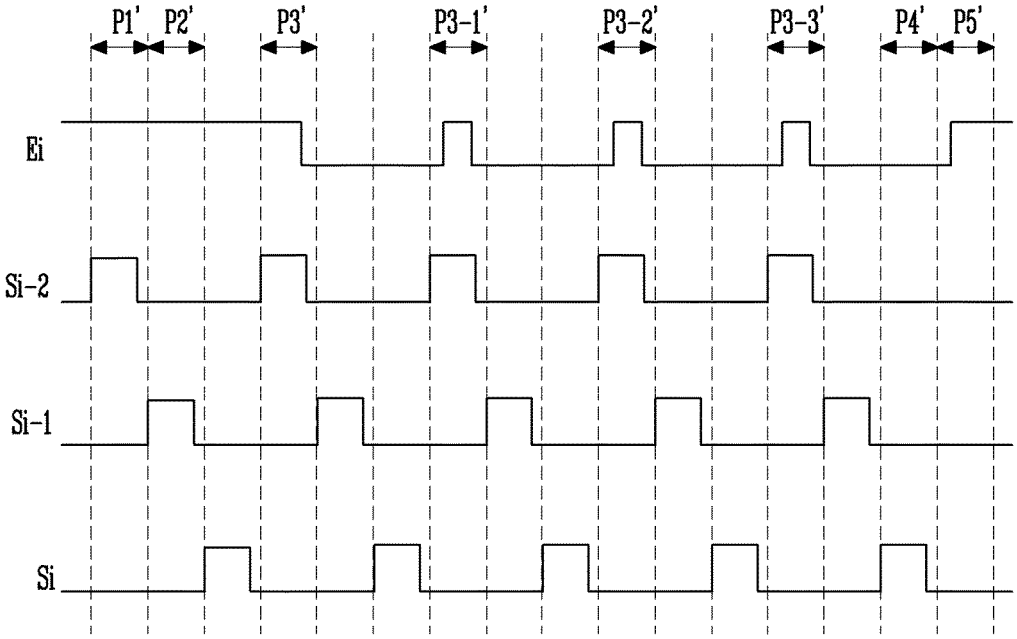
FIG. 6 is a diagram illustrating driving waveforms of signals supplied to the pixel shown in FIG. 5.

FIG. 6 is a diagram illustrating driving waveforms of signals supplied to a pixel shown in FIG. 5. Hereinafter, a driving operation of the pixel PXL2 will be described with reference to FIGS. 5 and 6.

Hereinafter, a description of common contents with the earlier described embodiments with reference to FIGS. 2 and 3 is omitted, and differences from the earlier described embodiments will be mainly described.

Referring to FIG. 6, the method of driving the pixel PXL2 may include light emission off, initialization, threshold voltage compensation, data write, and light emission.

The light emission off may be performed during a first period P1'. In the light emission off, by turning on the third transistor T3, a voltage of the reference power supply Vref (hereinafter, a reference voltage) may be supplied to the first node N1, and the fourth transistor T4 may maintain an on state.

A scan signal and a light emission control signal (e.g., signals having a high level) may be supplied to the (i−2)th scan line Si−2 and the ith light emission control line Ei during the first period P1'. Therefore, during the first period P1', a reference voltage may be supplied to the gate electrode of the second transistor T2. Because the reference power supply Vref is a low potential power supply, a low potential voltage may be applied to the gate electrode of the second transistor T2, so that the second transistor T2 may be turned off. Therefore, a current path from the first power supply ELVDD to the second power supply ELVSS may be disconnected, so that the organic light emitting diode OLED may be turned off.

Subsequently, the initialization may be performed during a second period P2'. During the initialization, an initialization voltage may be supplied to the second node N2 by turning on the fifth transistor T5 and the sixth transistor T6. A scan signal and the light emission control signal may be respectively supplied to the (i−1)th scan line Si−1 and the ith light emission control line Ei during the second period P2'.

Subsequently, the threshold voltage compensation may be performed during a third period P3'. During the threshold voltage compensation, the third transistor T3 and the fourth transistor T4 may be simultaneously turned on to store a threshold voltage of the second transistor T2 in the capacitor Cst.

During the third period P3', a scan signal and the light emission control signal may be supplied to the (i−2)th scan line Si−2 and the ith light emission control line Ei, respectively. Therefore, during the third period P3', the third transistor T3, the fourth transistor T4, and the fifth transistor T5 may maintain an on state, while the first transistor T1, the sixth transistor T6, and the seventh transistor T7 may maintain an off state.

Because the third transistor T3 maintains an on state during the third period P3', a voltage of the first node N1 may change into a reference voltage. In addition, during the third period P3', a voltage of the second node N2 may change into a value obtained by subtracting the threshold voltage of the second transistor T2 from the reference voltage. Therefore, the threshold voltage of the second transistor T2 may be stored in the capacitor Cst.

The threshold voltage compensation may be repeated at least twice in the same manner as described above. As described in FIG. 6, threshold voltage compensation processes may be performed during a (3-1)th period P3-1', a (3-2)th period P3-2', and a (3-3)th period P3-3'.

In the threshold voltage compensation performed during each of the (3-1)th period P3-1', the (3-2)th period P3-2', and the (3-3)th period P3-3', the threshold voltage of the second transistor T2 may be stored in the capacitor Cst by turning on the third transistor T3 and the fourth transistor T4 in the same manner as the threshold voltage compensation process performed during the third period P3'.

A scan signal and the light emission control signal may be respectively supplied to the (i−2)th scan line Si−2 and the ith light emission control line Ei during the (3-1)th period P3-1', (3-2)th period P3-2', and the (3-3)th period P3-3'.

The data write may be performed during a fourth period P4'. During the data write, a data signal may be supplied to the first node N1 by turning on the first transistor T1. Therefore, during the data write, the data signal transferred from the jth data line Dj may be supplied to the gate electrode of the second transistor T2.

The scan signal may be supplied to the ith scan line Si during the fourth period P4'. Therefore, during the fourth period P4', the first transistor T1 may maintain an on state, and the third to sixth transistors T3 to T6 may maintain an off state.

Lastly, the light emission may be performed during a fifth period P5'. During the light emission, a driving current corresponding to a voltage stored in the capacitor Cst may be supplied to the organic light emitting diode OLED from the second transistor T2.

During the fifth period P5', the scan signals may not be supplied to the scan lines (i.e., the (i−2)th scan line, the (i−1)th scan line, and the ith scan line).

The (i−1)th scan line Si−1, the ith scan line Si, and (i+1)th scan lines Si+1 may be coupled to the pixel PXL1 according to the above-described embodiment with reference to FIGS. 2 and 3. However, because the pixel PXL2 according to another embodiment further includes the seventh transistor T7, the (i−2)th scan line Si−2, the (i−1)th scan line Si−1, and the ith scan line Si may be coupled thereto. However, the same method of compensating for a threshold voltage of the second transistor T2 may be used in both embodiments.

Figure 7:
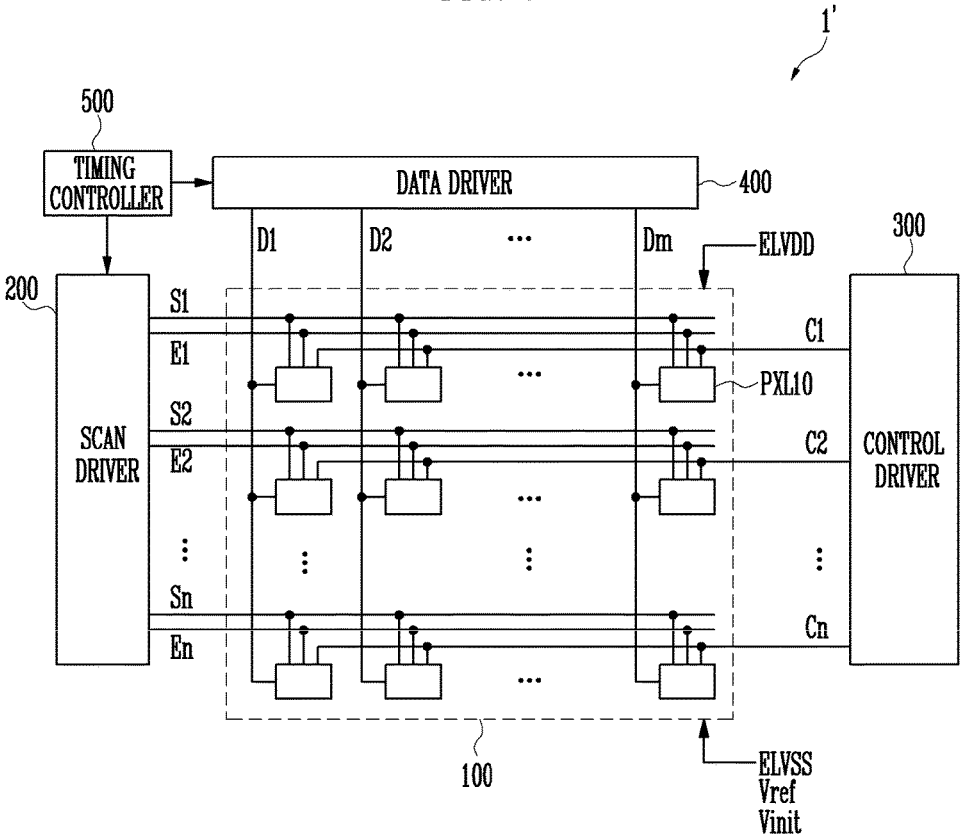
FIG. 7 is a diagram illustrating an organic light emitting display device according to another embodiment.

FIG. 7 is a diagram illustrating an organic light emitting display device according to another embodiment.

Hereinafter, a description of common features with the earlier described embodiment with reference to FIG. 1 is omitted, and differences from the earlier described embodiment will be mainly described.

An organic light emitting display device 1' according to another embodiment may further include a control driver 300. The control driver 300 may generate control signals, and may supply the generated control signals to control lines C1 to Cn in response to control of the timing controller 500. Therefore, pixels PXL10 may receive the control signals through the control lines C1 to Cn. The control driver 300 may sequentially supply the control signals to the first to nth control lines C1 to Cn.

For convenience of explanation, as illustrated in FIG. 7, the scan driver 200, the control driver 300, the data driver 400, and the timing controller 500 may be separate from each other. However, some of the components may be incorporated into each other.

In addition, FIG. 7 illustrates the n scan lines Si to Sn, the n control lines C1 to Cn, and then light emission control lines E1 to En. However, the invention may not be limited thereto. For example, at least one dummy scan line, at least one dummy control line, and at least one dummy light emission control line may be further included according to the structure of the pixel PXL10.

In addition, as described above, according to the circuit configuration, each of the pixels PXL10 may be additionally coupled to a scan line and/or a light emission control line located in a previous and/or subsequent horizontal line.

In addition, FIG. 7 illustrates the scan driver 200 coupled to the scan lines 51 to Sn and to the light emission control lines E1 to En. However, the invention is not limited thereto. For example, the light emission control lines E1 to En may be coupled to a separate driver, and may receive light emitting control signals therefrom.

Figure 8:
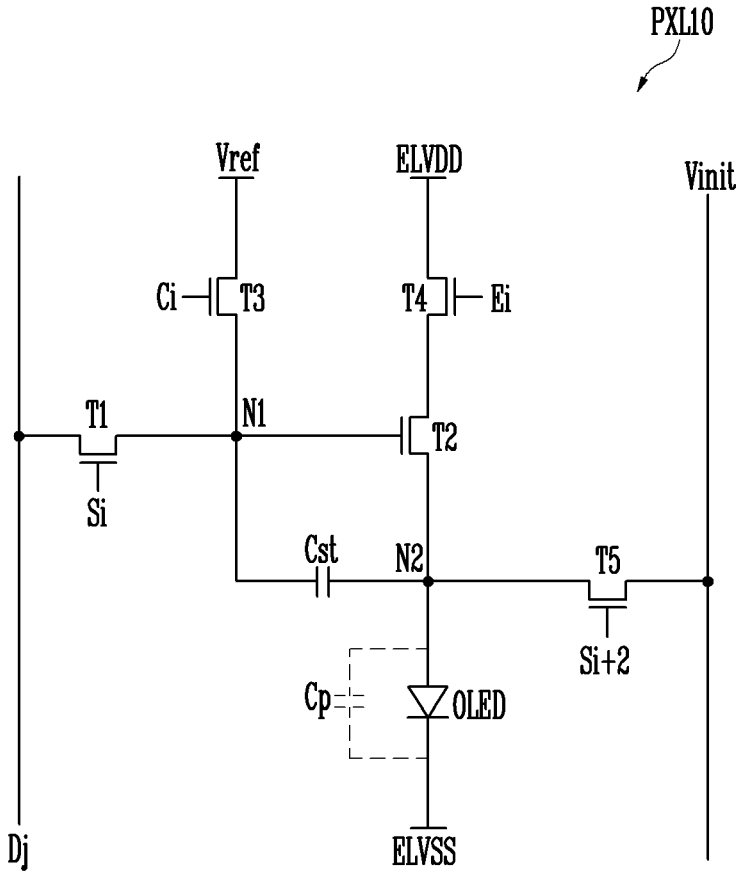
FIG. 8 is a circuit diagram illustrating an embodiment of a pixel shown in FIG. 7.

FIG. 8 is a circuit diagram illustrating an embodiment of a pixel shown in FIG. 7.

FIG. 8 illustrates the pixel PXL10 provided at an crossing region of the jth data line Dj, the ith scan line Si, the ith light emission control line Ei, and an ith control line Ci, where i is a natural number that is equal to or smaller than n, and where j is a natural number that is less than or equal to m.

Hereinafter, a description of common contents with the earlier described embodiments is omitted, and differences from the earlier described embodiments will be mainly described.

Referring to FIG. 8, the pixel PXL10 according to another embodiment may include the first transistor T1, the second transistor T2, the third transistor T3, the fourth transistor T4, the fifth transistor T5, the capacitor Cst, and the organic light emitting diode OLED.

The pixel PXL10 according to another embodiment may be coupled to an (i+2)th scan line Si+2 and to the ith control line Ci, and may also be coupled to the jth data line Dj, the ith scan line Si, and the ith light emission control line Ei.

The ith control line Ci may be coupled to the gate electrode of the third transistor T3 to control the turning on and off of the third transistor T3. In other words, the third transistor T3 may be turned on in response to the control signal supplied to the ith control line Ci. When the third transistor T3 is turned on, a voltage of the reference power supply Vref may be transferred to the first node N1.

According to another embodiment, only the fifth transistor T5 may be provided as a transistor for initializing the anode of the organic light emitting diode OLED (i.e., the second node N2) before the organic light emitting diode OLED resumes emitting light after light emission is off. The fifth transistor T5 may be coupled between the second node N2 and the initialization power supply Vinit. For example, the first electrode of the fifth transistor T5 may be coupled to the second node N2, the second electrode of the fifth transistor T5 may be coupled to the initialization power supply Vinit, and the gate electrode of the fifth transistor T5 may be coupled to the (i+2)th scan line Si+2. The fifth transistor T5 may be turned on in response to a scan signal supplied to the (i+2)th scan line Si+2. When the fifth transistor T5 is turned on, a voltage of the initialization power supply Vinit may be transferred to the second node N2.

Figure 9:
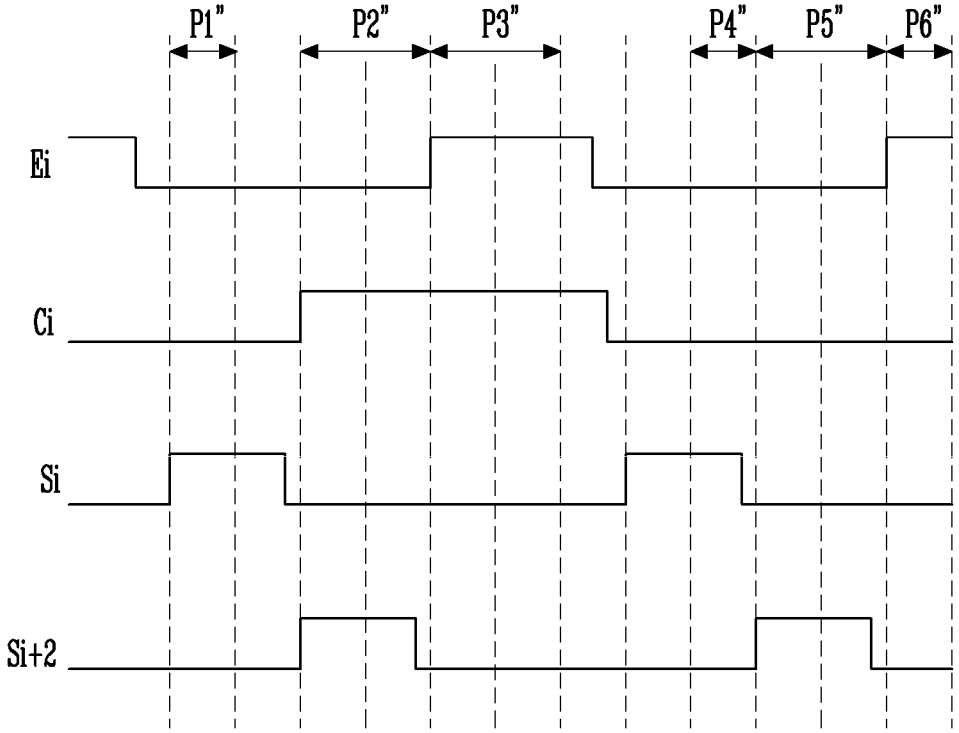
FIG. 9 is a diagram illustrating driving waveforms of signals supplied to the pixel shown in FIG. 8.

FIG. 9 is a diagram illustrating driving waveforms of signals supplied to the pixel shown in FIG. 8. Hereinafter, a driving operation of the pixel PXL10 is described with reference to FIGS. 8 and 9.

Hereinafter, a description of common contents with the earlier described embodiment is omitted and differences from the earlier described embodiment will be mainly described.

Referring to FIG. 9, a method of driving the pixel PXL10 according to this embodiment may include light emission off, first initialization, threshold voltage compensation, data write, second initialization, and light emission.

The light emission off may be performed during a first period P1". During the light emission off, the third transistor T3, the fourth transistor T4 and the fifth transistor T5 may maintain an off state. Because the fourth transistor T4 is turned off, a current path from first power supply ELVDD to the second power supply ELVSS may be disconnected so that the organic light emitting diode OLED may be turned off.

Subsequently, the first initialization may be performed during a second period P2". During the first initialization, an initialization voltage may be supplied to the second node N2 by turning on the fifth transistor T5. A scan signal (e.g., a signal having a high level) may be supplied to the (i+2)th scan line Si+2 during the second period P2".

In addition, during the first initialization, the third transistor T3 may also be turned on to supply a reference voltage to the first node N1. A control signal may also be supplied to the ith control line Ci during the second period P2".

By performing the above-described initialization operation, the pixel PXL10 may be initialized so as to be unaffected by the previous unit period.

Voltages of the first node N1 and the second node N2 may satisfy the following Equation (8):

$$VN1=Vref$$

$$VN2=Vinit \qquad \text{[Equation (8)]}$$

(where VN1 is the voltage of the first node N1, Vref is the reference voltage, VN2 is the voltage of the second node N2, and Vinit is the initialization voltage).

The threshold voltage compensation may be performed during a third period P3". During the threshold voltage compensation, a threshold voltage of the second transistor T2 may be stored in the capacitor Cst by turning on the third transistor T3 and the fourth transistor T4. A control signal and a light emission control signal may be respectively supplied to the ith control line Ci and the ith light emission control line Ei during the third period P3".

During the third period P3", the third transistor T3 and the fourth transistor T4 may maintain an on state, and the first transistor T1 and the fifth transistor T5 may maintain an off state.

During the third period P3", the voltage of the first node N1 may be maintained at the reference voltage. During the third period P3", the voltage of the second node N2 may change from the initialization voltage to a value obtained by subtracting the threshold voltage of the second transistor T2 from the reference voltage.

The voltages of the first node N1 and the second node N2 may satisfy the following Equation (9):

$$VN1=Vref$$

$$VN2=Vref-Vth \qquad \text{[Equation (9)]}$$

(VN1 is the voltage of the first node N1, Vref is the reference voltage, VN2 is the voltage of the second node N2, and Vth is the threshold voltage of the second transistor T2).

To maintain the organic light emitting diode OLED in a non-light emitting state during the threshold voltage compensation, the voltage of the second node N2 (i.e., the reference voltage) may be set to a voltage level at which the organic light emitting diode OLED is maintained at the non-light emitting state.

The time during which the threshold voltage compensation is performed may be determined by the control signal supplied to the ith control line Ci and by the light emission control signal supplied to the ith light emission control line Ei.

Therefore, the time during which the threshold voltage compensation is performed may be controlled by controlling a width of the light emission control signal supplied to the ith control line Ci and by controlling a width of the control signal supplied to the ith light emission control line Ei.

The data write may be performed during a fourth period P4". During the data write, a data signal may be supplied to the first node N1 by turning on the first transistor T1. Therefore, during the data write, the data signal transferred from the jth data line Dj may be supplied to the gate electrode of the second transistor T2.

During the fourth period P4", a scan signal may be supplied to the ith scan line Si. Therefore, during the fourth period P4", the first transistor T1 may maintain an on state, while the third transistor T3, the fourth transistor T4 and the fifth transistor T5 may maintain an off state.

During the fourth period P4", the voltage of the first node N1 may be maintained at a voltage of the data signal (hereinafter, a data voltage). During the fourth period P4", the voltages of the first node N1 and the second node N2 may satisfy the following Equation (10):

$$VN1=Vdata$$

$$VN2=Vref-Vth \qquad \text{[Equation (10)]}$$

(where VN1 is the voltage of the first node N1, Vdata is the data voltage, Vref is the reference voltage, VN2 is the voltage of the second node N2, and Vth is the threshold voltage of the second transistor T2).

The second initialization may be performed during a fifth period P5". During the second initialization, an initialization voltage may be supplied again to the second node N2 by turning on the fifth transistor P5'. A scan signal may be supplied to the (i+2)th scan line Si+2 during the fifth period P5. Therefore, the fifth transistor P5 may maintain an on state, while the first transistor T1, the third transistor T3, and the fourth transistor T4 may maintain an off state.

When the initialization voltage is supplied to the second node N2, the voltage of the first node N1 may also change through a coupling operation of the capacitor Cst. Therefore, the threshold voltage of the second transistor stored in the capacitor Cst may be maintained during the data write.

The voltages of the first node N1 and of the second node N2 may satisfy the following Equation (11):

$$VN1=Vdata-Vref+Vth$$

$$VN2=Vinit \qquad \text{[Equation (11)]}$$

(VN1 is the voltage of the first node N1, Vdata is the data voltage, Vref is the reference voltage, Vth is the threshold voltage of the second transistor T2, VN2 is the voltage of the second node N2, and Vinit is the initialization voltage).

Lastly, the light emission may be performed during a sixth period P6". During the light emission, a driving current corresponding to the voltage stored in the capacitor Cst may be supplied to the organic light emitting diode OLED from the second transistor T2.

During the sixth period P6", the scan signals and the control signal may not be supplied to the scan lines Si and Si+2 and the ith control line Ci, respectively. Therefore, the first transistor T1, the third transistor T3, and the fifth transistor T5 may maintain an off state.

During the sixth period P6", voltages according to Equation (12) may be stored in the first node N1 and the second node N2. Thus, the second transistor T2 may supply a current corresponding to Equation (12) to the organic light emitting diode.

$$VN1=V\text{data}-(V\text{oled}-V\text{ref}+V\text{th})$$

$$\text{VN2}=\text{Voled}$$

$$I\text{oled}=k\times(V\text{gs}-V\text{th})2=k\times(V\text{data}-V\text{ref})2 \qquad \text{[Equation (12)]}$$

(where VN1 is the voltage of the first node N1, Vdata is the data voltage, Voled is a driving voltage of the second transistor T2, Vref is the reference voltage, Vth is the threshold voltage of the second transistor T2, VN2 is the voltage of the second node N2, loled is the driving current output from the second transistor T2, k is a constant, and Vgs is a gate-source voltage of the second transistor T2).

In other words, as shown in Equation (12) above, because the driving current output from the second transistor T2 may be determined regardless of the threshold voltage Vth, uneven brightness caused by a threshold voltage variation of driving transistors included in the pixels PXL10 (i.e., a threshold voltage variation of the second transistors T2) may be eliminated.

According to an embodiment, because a driving current supplied to an organic light emitting diode is determined regardless of a threshold voltage of a driving transistor, a pixel capable of eliminating uneven brightness caused by a threshold voltage variation of driving transistors, a method of driving the pixel, and an organic light emitting display device including the pixel are described.

According to embodiments, there may be provided a pixel capable of controlling a threshold voltage compensation time of a driving transistor, a method of driving the pixel, and an organic light emitting display device including the pixel.

Although example embodiments are disclosed herein, these embodiments should not be construed to be limiting. Those of ordinary skill in the art would recognize that various changes in form and details may be made without departing from the spirit and scope.

What is claimed is:

1. A pixel, comprising:

a first transistor comprising a first electrode connected to a data line, and a second electrode connected to a first node;

a second transistor comprising a first electrode, a second electrode connected to a second node, and a gate electrode connected to the first node for receiving a data signal at the gate electrode from the data line through the first transistor;

a third transistor comprising a first electrode connected to a reference power supply, and a second electrode connected to the first node;

a fourth transistor comprising a first electrode connected to a first power supply, and a second electrode connected to the first electrode of the second transistor to connect the second transistor to the first power supply to supply a voltage of the first power supply to the second transistor through the fourth transistor;

a capacitor comprising a first electrode connected to the first node, and a second electrode connected to the second node;

an organic light emitting diode connected between the second node and a second power supply;

a fifth transistor connected to an anode of the organic light emitting diode; and a sixth transistor comprising a first electrode connected to the fifth transistor, and a second electrode connected to an initialization power supply.

2. The pixel of claim 1, wherein the fifth transistor comprises a first electrode connected to the anode of the organic light emitting diode, a second electrode connected to the sixth transistor, and a gate electrode connected to an ith light emission control line, where i is a natural number.

3. The pixel of claim 2, wherein the third transistor further comprises a gate electrode connected to an (i−1)th scan line, and wherein the sixth transistor further comprises a gate electrode connected to an (i+1)th scan line.

4. The pixel of claim 3, wherein the second transistor is configured to maintain an off state during a first period, and wherein the fifth transistor and the sixth transistor are configured to maintain an on state during a second period.

5. The pixel of claim 4, wherein the third transistor and the fourth transistor are configured to maintain an on state during a third period.

6. The pixel of claim 5, wherein the third period is repeated at least twice at a time interval for a 1 frame period.

7. The pixel of claim 5, wherein the first transistor is configured to maintain an on state during a fourth period, and wherein the fifth transistor and the sixth transistor are configured to maintain an on state during a fifth period.

8. The pixel of claim 2, further comprising a seventh transistor connected between the fifth transistor and the initialization power supply.

9. The pixel of claim 8, wherein the third transistor further comprises a gate electrode connected to an (i−2)th scan line, wherein the sixth transistor further comprises a gate electrode connected to an (i−1)th scan line, and wherein the seventh transistor comprises a first electrode connected to the first electrode of the sixth transistor, a second electrode connected to the second electrode of the sixth transistor, and a gate electrode connected to an ith scan line.

10. The pixel of claim 9, wherein the fifth transistor and the sixth transistor are configured to maintain an on state, and wherein the seventh transistor is configured to maintain an off state, during a second period, and wherein a voltage of the initialization power supply is transmitted to the second node during the second period.

11. An organic light emitting display device, comprising:

a plurality of pixels comprising n scan lines, n light emission control lines, and m data lines, where n and m are natural numbers that are greater than or equal to 2;

a scan driver for supplying scan signals to the scan lines, and for supplying light emission control signals to the light emission control lines; and a data driver for supplying data signals to the data lines, wherein a pixel connected to an ith scan line, to an ith light emission control line, and to a jth data line, where i is a natural number that is less than or equal to n, and where j is a natural number that is less than or equal to m, comprises:

a first transistor connected between the jth data line and a first node, and configured to be turned on in response to a scan signal supplied to the ith scan line;

a second transistor comprising a first electrode, a second electrode connected to a second node, and a gate electrode connected to the first node for receiving a data signal at the gate electrode from the jth data line through the first transistor;

a third transistor comprising a first electrode connected to a reference power supply, and a second electrode connected to the first node;

a fourth transistor comprising a first electrode connected to a first power supply, and a second electrode connected to the first electrode of the second transistor to connect the second transistor to the first power supply to supply a voltage of the first power supply to the second transistor through the fourth transistor, wherein the fourth transistor is configured to be turned on in response to a light emission control signal supplied to the ith light emission control line;

a capacitor comprising a first electrode connected to the first node, and a second electrode connected to the second node;

an organic light emitting diode connected between the second node and a second power supply;

a fifth transistor connected to an anode of the organic light emitting diode; and a sixth transistor comprising a first electrode connected to the fifth transistor, and a second electrode connected to an initialization power supply.

12. The organic light emitting display device of claim 11, wherein the fifth transistor comprises a first electrode connected to the anode of the organic light emitting diode, a second electrode connected to the sixth transistor, and a gate electrode connected to the ith light emission control line.

13. The organic light emitting display device of claim 12, wherein the third transistor further comprises a gate electrode connected to an (i−1)th scan line, and wherein the sixth transistor further comprises a gate electrode connected to an (i+1)th scan line.

14. The organic light emitting display device of claim 13, wherein the (i−1)th scan line is configured to receive a scan signal during a first period and a third period, wherein the ith scan line is configured to receive a scan signal during a fourth period, and wherein the (i+1)th scan line is configured to receive a scan signal during a second period and a fifth period.

15. The organic light emitting display device of claim 14, wherein the ith light emission control line is configured to receive a light emission control signal during the third period and a sixth period.

16. The organic light emitting display device of claim 15, wherein a voltage of the second node is compensated corresponding to a threshold voltage of the second transistor whenever the third transistor and the fourth transistor are turned on after the second period ends.

17. The organic light emitting display device of claim 12, wherein the pixel further comprises a seventh transistor comprising a first electrode connected to the first electrode of the sixth transistor, a second electrode connected to the second electrode of the sixth transistor, and a gate electrode connected to the ith scan line.

18. The organic light emitting display device of claim 17, wherein the third transistor further comprises a gate electrode connected to an (i−2)th scan line, and wherein the sixth transistor further comprises a gate electrode connected to an (i−1)th scan line.

19. The organic light emitting display device of claim 18, wherein the (i−2)th scan line is configured to receive a scan signal during a first period and a third period, wherein the (i−1)th scan line is configured to receive a scan signal during a second period, and wherein the ith scan line is configured to receive a scan signal during a fourth period.

20. The organic light emitting display device of claim 19, wherein the ith light emission control line is configured to receive a light emission control signal during the first period, the second period and the third period, and wherein a voltage of the second node is compensated corresponding to a threshold voltage of the second transistor whenever the third transistor and the fourth transistor are turned on after the second period ends.

21. A pixel, comprising:

a first transistor connected between a data line and a first node;

a second transistor comprising a first electrode, a second electrode connected to a second node, and a gate electrode connected to the first node for receiving a data signal at the gate electrode from the data line through the first transistor;

a third transistor coupled between the first node and a reference power supply, and comprising a gate electrode connected to a control line;

a fourth transistor comprising a first electrode connected to a first power supply, and a second electrode connected to the first electrode of the second transistor to connect the second transistor to the first power supply to supply a voltage of the first power supply to the second transistor through the fourth transistor;

a capacitor connected between the first node and the second node;

an organic light emitting diode connected between the second node and a second power supply; and a fifth transistor comprising a first electrode connected to an anode of the organic light emitting diode, and a second electrode connected to an initialization power supply.

22. The pixel of claim 21, wherein the first transistor comprises a first electrode connected to the data line, a second electrode connected to the first node, and a gate electrode connected to an ith scan line, i being a natural number, wherein the third transistor comprises a first electrode connected to the reference power supply, and a second electrode connected to the first node, and wherein the fourth transistor comprises a gate electrode connected to a light emission control line.

23. The pixel of claim 22, wherein the fifth transistor further comprises a gate electrode connected to an (i+2)th scan line.

24. The pixel of claim 23, wherein the fourth transistor is configured to maintain an off state during a first period and a second period, and wherein the third transistor and the fifth transistor are configured to maintain an on state during the second period.

25. The pixel of claim 24, wherein the third transistor and the fourth transistor are configured to maintain an on state during a third period.

* * * * *